US007865101B2

(12) United States Patent
Ahn

(10) Patent No.: US 7,865,101 B2
(45) Date of Patent: Jan. 4, 2011

(54) FUSING SYSTEM AND CONTROL METHOD THEREOF

(75) Inventor: Byung-sun Ahn, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 221 days.

(21) Appl. No.: 12/060,915

(22) Filed: Apr. 2, 2008

(65) Prior Publication Data

US 2009/0060549 A1 Mar. 5, 2009

(30) Foreign Application Priority Data

Sep. 3, 2007 (KR) ..... 10-2007-0089160

(51) Int. Cl.
*G03G 15/20* (2006.01)

(52) U.S. Cl. ..... 399/69; 219/619; 399/70

(58) Field of Classification Search ..... 399/67–70, 399/328, 329

See application file for complete search history.

(56) References Cited

U.S. PATENT DOCUMENTS

2007/0098426 A1* 5/2007 Soya ..... 399/67

* cited by examiner

*Primary Examiner*—Hoang Ngo
(74) *Attorney, Agent, or Firm*—Staas & Halsey LLP

(57) ABSTRACT

A fusing system includes: a fusing unit which comprises a fusing belt which rotates around outer surfaces of at least two rollers which are distanced from each other, and a pressing roller which presses a printing medium together with the fusing belts and fuses an image which is transferred to the printing medium; a heat source which receives power to generate heat, and is mounted inside at least one of the two rollers; a driving source which drives at least one of the two rollers; a sensing unit which senses a surface temperature of the fusing belt; and a control unit which controls the heat source and the driving source so that the fusing belt can be driven when the temperature of the fusing unit increases if a printing order is applied.

23 Claims, 10 Drawing Sheets

FUSING SYSTEM AND CONTROL METHOD THEREOF

CROSS-REFERENCE TO RELATED APPLICATION

This application claims all benefits accruing under 35 U.S.C. §119 from Korean Patent Application No. 2007-89160, filed on Sep. 3, 2007 in the Korean Intellectual Property Office, the disclosure of which is incorporated herein by reference.

BACKGROUND OF THE INVENTION

1. Field of the Invention

The present invention relates to an image forming apparatus, and more particularly, to a fusing system and a control method thereof driving a fusing unit and preheating the fusing unit to a predetermined temperature in an image data processing time to improve a fusing process.

2. Description of the Related Art

In general, an electro-photographic image forming apparatus, such as, a laser printer, a facsimile machine, a photocopier and a multi-functional product, forms an electrostatic latent image on an photoreceptor charged to have a predetermined electric potential by means of exposing, develops with a predetermined toner, and transmits and fuses a toner image to a printable medium to print an image. A fusing unit is provided on a printing path of the image forming apparatus, to fuse a transferred toner image to the printable medium by means of heating and pressing. In addition, a fusing system is provided to control the fusing unit depending on a control signal applied from a control unit so as to perform a fusing process.

FIG. 1 is a schematic view illustrating a fusing system of a typical image forming apparatus. As shown in FIG. 1, the fusing system includes a fusing unit 10, a sensing unit 20 and a control unit 31, and a power source 35.

The fusing unit 10 includes a fusing roller 13 containing a heater 11 therein, and a pressing roller 17 disposed to face the fusing roller 13 and elastically pressed toward the fusing roller 13 by means of an elastic member 15.

The fusing roller 13 includes a core 13*a* formed of metal, and an elastic layer 13*b* provided to a surface of the core 13*a*. Accordingly, the core 13*a* is heated by a radiant energy of the heater 11, and the elastic layer 13*b* is heated by thermal conduction. If the printable medium 1 carrying a non fused toner image 3 is transported to the fusing unit 10 passing through a fusing nip N formed between the fusing roller 13 and the pressing roller 17 which rotate, the toner image 3 is heated and pressed to be fused on the printable medium 1, thereby completing the fusing process.

The sensing unit 20 includes a thermistor 21 for sensing a surface temperature of the fusing roller 13, a thermostat 23 for blocking the power source 35 applied to the heater 11 if the surface temperature of the fusing roller 13 exceeds a predetermined critical temperature, and a power switching unit 25 arranged to turn ON/Off for supplying of the power source 35 to the heat 11 depending on a signal from the control unit 31. The thermistor 21 senses the surface temperature of the fusing roller 13, and transmits the sensed result to the control unit 31. The control unit 31 compares the sensed temperature with a predetermined critical temperature to control the power supplying to the heater 11 through the power switching unit 25, so that the surface temperature of the fusing roller 13 can maintain a fusing temperature.

FIG. 2 is a flowchart illustrating a temperature control method of the fusing system shown in FIG. 1. As shown in FIG. 1 and FIG. 2, in the fusing system, if power is applied to the image forming apparatus, the control unit 31 heats the fusing roller 13 so that the surface temperature of the fusing roller 13 can increases up to a printing standby temperature, that is, preheats the fusing roller 13 at block S1. Then, the surface temperature of the fusing roller 13 maintains the printing standby temperature to stand by for a printing order until the printing operation is performed at block S3. Here, the printing operation indicates supplying of the printable medium, developing, transferring and fusing processes which are performed after the image forming apparatus receives the printing order from a host computer, and printing data is completely down loaded.

Then, whether the printing operation is performed or not is determined at block S5. If the printing operation is not performed, the printing standby state is maintained until the printing operation is performed at block S5. On the other hand, if the printing operation is performed, the fusing roller 13 is heated so that the surface temperature of the fusing roller 13 can become the fusing temperature of approximately 180° C. to 190° C. which is higher than the printing standby temperature at block S7. Here, if the printing standby temperature is determined to be close to the fusing temperature, a temperature increasing time can be reduced during the fusing process. However, during the printing standby state, the printing medium is not supplied and the fusing unit 10 is not driven. As a result, the fusing roller 13 and the pressing roller 17 are apt to be deformed by heat and a fire danger due to overheating increases if the printing standby temperature is raised. Accordingly, there is a limit in raising the printing standby temperature to be more than approximately 140° C.

Then, the printable medium 1 formed with the non fused toner image 3 passes between the fusing roller 13 and the pressing roller 17 to perform the fusing process at block S9.

In the fusing system shown in FIG. 1 and FIG. 2, the elastic layer 13*b* is formed of material having a low thermal conduction to prevent a surface temperature of the elastic layer 13*b* from largely varying although the heater 11 is repeatedly turned ON/OFF during fusing. In this case, a lot of time is required so that the surface temperature of the elastic layer 13*b* increases from the printing standby temperature to the fusing temperature by means of the heat supplied from the heater 11. Accordingly, time to print a first page of the printable medium increases.

In addition to the fusing system shown in FIG. 1, there is another fusing unit using a fusing belt configuration. Such a fusing unit includes a heating roller distanced from a fusing roller and containing a heater therein, and a fusing belt rotating around outer surfaces of the fusing roller and the heating roller. Here, a part of the fusing belt contacting to the heating roller is partially heated. Also, the heated part is expanded to the total surface of the fusing belt by means of rotation of the fusing belt in fusing so that the fusing nip can maintain the fusing temperature.

In a preheating process of the belt type fusing unit, the heater heats the heating roller under the state that the fusing belt is stopped. Accordingly, a part of the fusing belt contacting with the heating roller or positioned adjacently thereto is capable of maintaining the preheating temperature by means of the thermal conduction, but the other parts thereof have a temperature lower than the preheating temperature.

Accordingly, in an initial printing after a substantial time elapses in the printing standby state, the partially heated part of the fusing belt applies a predetermined amount of heat to the printable medium to maintain a fusing ability. However, the other parts having the low temperature have an insufficient amount of heat, thereby causing an inferior fusing process.

SUMMARY OF THE INVENTION

Several aspects and example embodiments of the present invention provide a fusing system and a control method thereof driving and preheating a fusing unit before a printing operation is performed after a printing order to maintain a preliminary fusing temperature which is higher than a printing standby temperature and lower than a fusing temperature, thereby reducing a temperature increasing time up to the fusing temperature, and avoiding an inferior fusing when printing a first page of a printable medium.

Additional aspects and/or advantages of the invention will be set forth in part in the description which follows and, in part, will be obvious from the description, or may be learned by practice of the present invention.

In accordance with an example embodiment of the present invention, a fusing system comprise: a fusing unit which comprises a fusing belt which rotates around outer surfaces of at least two rollers which are distanced from each other, and a pressing roller which presses a printing medium together with the fusing belts and fuses an image which is transferred to the printing medium; a heat source which receives power to generate heat, and is mounted inside at least one of the two rollers; a driving source which drives at least one of the two rollers; a sensing unit which senses a surface temperature of the fusing belt; and a control unit which controls the heat source and the driving source so that the fusing belt can be driven when the temperature of the fusing unit increases if a printing order is applied.

According to an aspect of the present invention, the control unit may control the heat source and the driving source based on the temperature of the fusing unit which is sensed by the sensing unit, and a printing proceeding state.

According to another aspect of the present invention, the control unit may control the temperature of the fusing unit to maintain a preliminary fusing temperature $T_2$ which is higher than a printing standby temperature $T_1$, and lower than a fusing temperature $T_3$ during an image data processing time before a printing operation is started after the printing order is applied.

According to an aspect of the present invention, the printing standby temperature $T_1$ may be the temperature of the fusing unit by means of preheating in a printing standby state, and the fusing temperature $T_3$ is the temperature of the fusing unit during the printing operation.

According to an aspect of the present invention, the control unit respectively may turn ON/OFF the heat source and the driving source so that the heat source and the driving source can be respectively driven by a predetermined time unit during the image data processing time.

In accordance with another example embodiment of the present invention, a fusing system comprises: a fusing unit which forms a fusing nip by means of a pressing force, and heats and presses a printing medium which passes through the fusing nip to fuse an image which is transferred to the printing medium; a heat source which receives power to generate heat, and supplies the heat to the fusing unit; a driving source which drives the fusing unit; a sensing unit which senses the temperature of the fusing unit; and a control unit which controls the heat source and the driving source based on the temperature of the fusing unit which is sensed by the sensing unit, and a printing proceeding state, wherein the control unit controls the temperature of the fusing unit so as to maintain a preliminary fusing temperature $T_2$ which is higher than a printing standby temperature $T_1$, and lower than a fusing temperature $T_3$ during an image data processing time before a printing operation is started after a printing order is applied.

According to an aspect of the present invention, the printing standby temperature $T_1$ may be the temperature of the fusing unit by means of preheating in a printing standby state, and the fusing temperature $T_3$ is the temperature of the fusing unit during the printing operation.

According to an aspect of the present invention, the control unit may turn ON/OFF the heat source so that the heat source can be driven by a predetermined time unit during the image data processing time.

According to another aspect of the present invention, the control unit may turn ON/OFF the driving source so that the driving source can be driven by a predetermined time unit during the image data processing time.

According to an aspect of the present invention, the fusing unit may comprise: a fusing roller which is driven by means of the driving source, a heating roller which is distanced from the fusing roller, and contains the heat source therein, a fusing belt which rotates around outer surfaces of the fusing roller and the heating roller, and a pressing roller which is elastically biased toward the fusing roller to press the printing medium together with the fusing roller and the fusing belt.

According to an aspect of the present invention, the fusing unit may comprise: a fusing roller which is driven by means of the driving source, and contains the heat source therein, and a pressing roller which is elastically biased toward the fusing roller to press the printing medium together with the fusing roller.

In accordance with another example embodiment of the present invention, a control method of a fusing system which comprises a fusing unit which comprises a fusing belt which rotates around outer surfaces of at least two rollers which are distanced from each other, and a pressing roller which presses a printing medium together with the fusing belts and fuses an image which is transferred to the printing medium, the control method of the fusing system comprising: preheating the fusing unit so that the temperature of the fusing unit can maintain a printing standby temperature, and standing by for printing until a printing order is applied; controlling a heat source and a driving source so that the fusing belt can be driven when the temperature of the fusing unit increases if the printing order is applied; and controlling the heat source so that the temperature of the fusing unit can maintain a fusing temperature after a printing operation is started.

According to an aspect of the present invention, the controlling the heat source and the driving source may comprise controlling the heat source so that the temperature of the fusing unit can maintain a preliminary fusing temperature $T_2$ which is higher than a printing standby temperature $T_1$, and lower than a fusing temperature $T_3$ during an image data processing time before the printing operation is started after the printing order is applied.

According to another aspect of the present invention, the controlling the heat source and the driving source may comprise respectively turning ON/OFF the heat source and the driving source so that the heat source and the driving source can be driven by a predetermined time unit during the image data processing time.

In accordance with yet another example embodiment of the present invention, a control method of a fusing system comprises: preheating a fusing unit which fuses an image which is transferred to a printing medium so that the temperature of the fusing unit can maintain a printing standby temperature $T_1$, and standing by for printing until a printing order is applied;

controlling a heat source which supplies heat to the fusing unit so that the temperature of the fusing unit can maintain a preliminary fusing temperature $T_2$ which is higher than the printing standby temperature $T_1$, and lower than a fusing temperature $T_3$ during an image data processing time before a printing operation is started after the printing order is applied; and controlling the heat source so that the temperature of the fusing unit can maintain a fusing temperature $T_3$ after the printing operation is started.

According to an aspect of the present invention, the controlling the heat source during the image data processing time may comprise turning ON/OFF the heat source so that the heat source can be driven by a predetermined time unit.

According to an aspect of the present invention, the control method of the fusing system may further comprise controlling a driving source which drives the fusing unit so that the fusing unit can be driven during the image data processing time.

In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
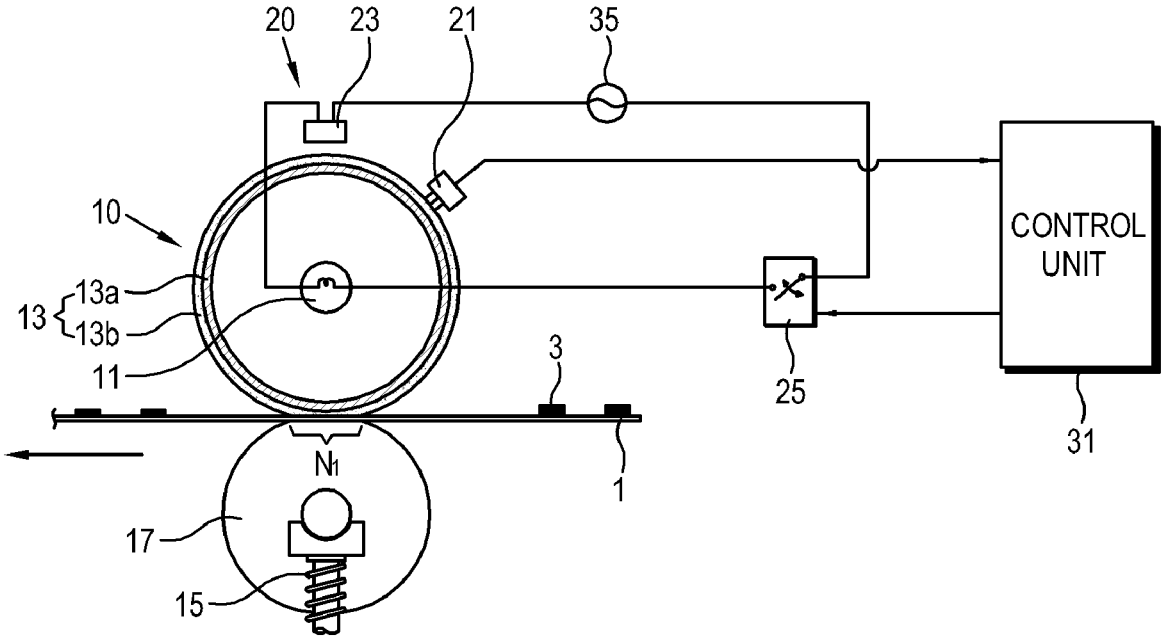
FIG. 1 (RELATED ART)
FIG. 1 is a schematic view illustrating a fusing system of a typical image forming apparatus.
Figure 2:
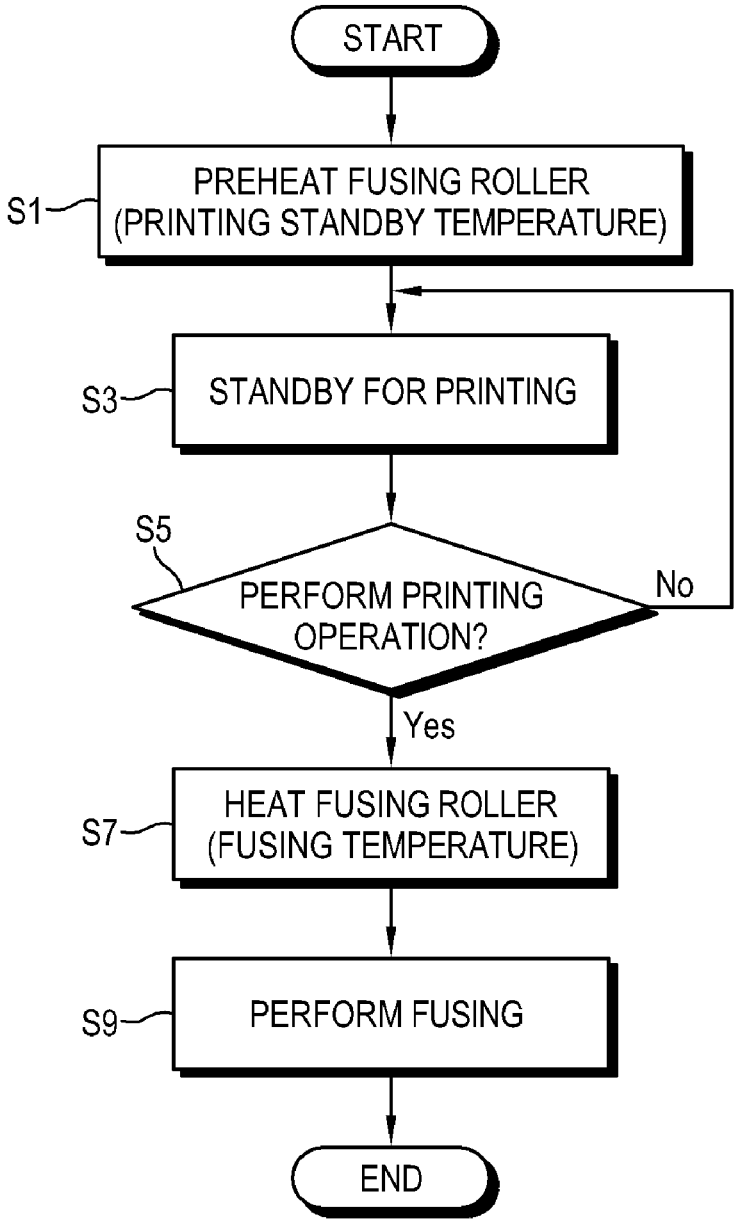
FIG. 2 (RELATED ART)
FIG. 2 is a flowchart illustrating a temperature control method of the fusing system shown in FIG. 1.

Reference will now be made in detail to the present embodiments of the present invention, examples of which are illustrated in the accompanying drawings, wherein like reference numerals refer to like elements throughout. The embodiments are described below in order to explain the present invention by referring to the figures.

Figure 3:
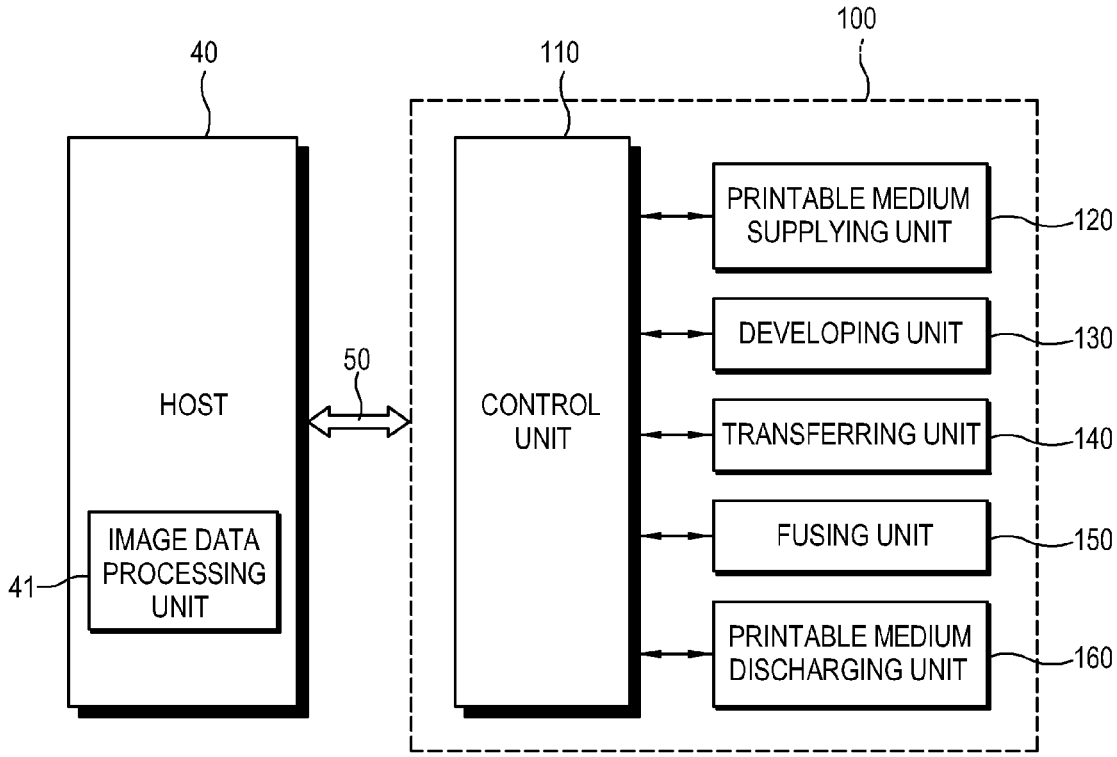
FIG. 3 is a block diagram illustrating an image forming system employing a fusing system according to an example embodiment of the present invention.
Figure 4:
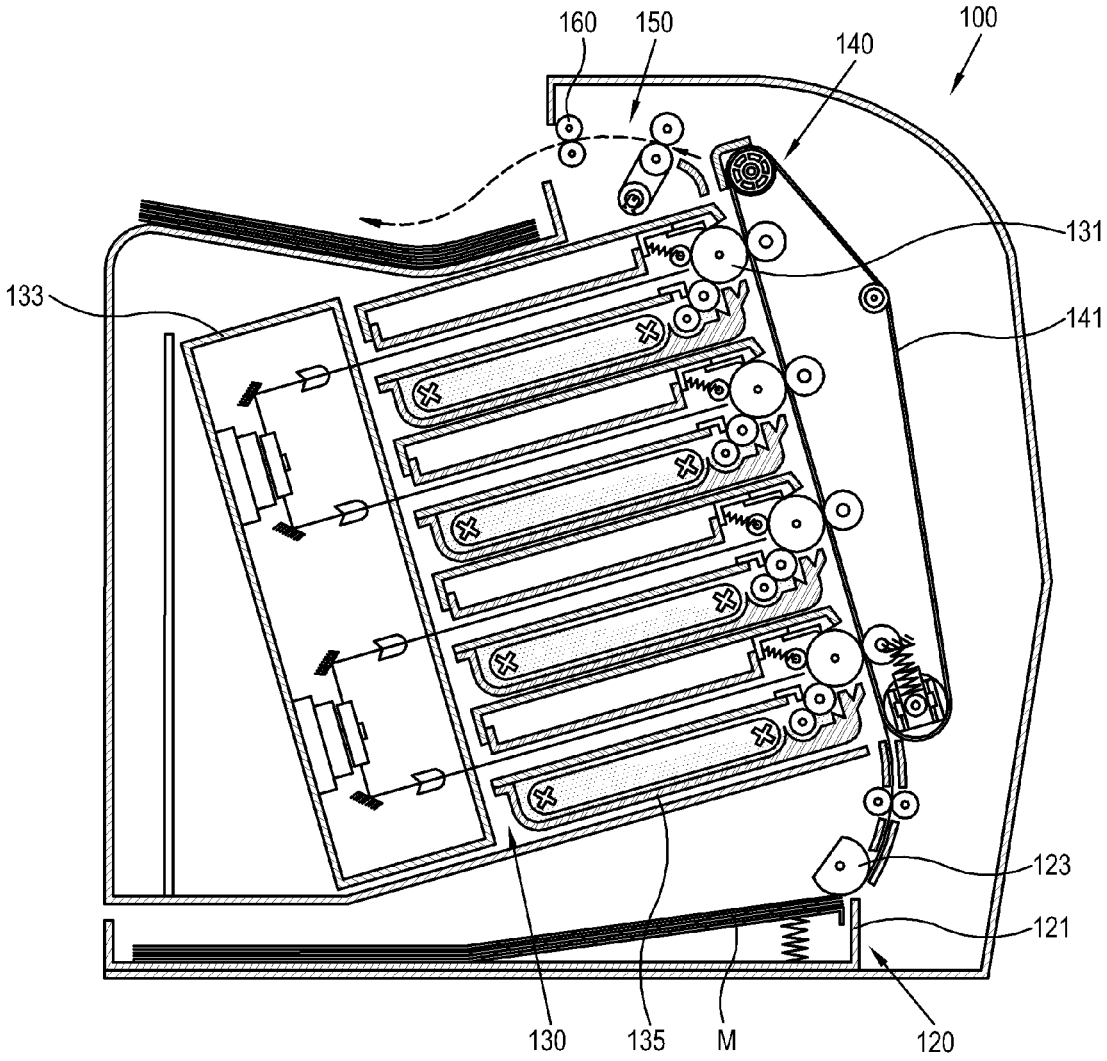
FIG. 4 is a schematic view illustrating an image forming apparatus in FIG. 3.

FIG. 3 is a block diagram of an image forming system employing a fusing system according to an example embodiment of the present invention, and FIG. 4 is a schematic view of an image forming apparatus shown in FIG. 3.

As shown in FIG. 3 and FIG. 4, the image forming system includes a host 40, and an image forming apparatus 100 connected to the host 40. The host 40 and the image forming apparatus 100 are connected through a bus 50, such as a serial bus, a parallel bus, or the like. The host 40 sends a printing order to the image forming apparatus 100, and processes image data for an image forming operation. For this, the host 40 includes an image data processing unit 41 to convert a printing target file into image data which is capable of being printed on a printable medium. Here, for an available emulation, there are a graphic device interface (GDI), a printer control language (PCL) and a post script (PS). When the printing order is applied, time for processing the image data is influenced by the amount of data and the type of the emulation.

The image forming apparatus 100 includes a control unit 110 for receiving the printing order and the image data from the host 40 and for controlling following elements, a printable medium supplying unit 120, a developing unit 130 developing a toner image, a transferring unit 140 transferring the toner image formed by the developing unit 130 to a printable medium, a fusing unit 150 fusing the transferred toner image, and a printable medium discharging unit 160.

The developing unit 130 includes at least one photosensitive medium 131, a light scanning unit 133 for scanning a light beam to the photosensitive medium 131 to form an electrostatic latent image, and a development unit 135 for developing the toner image from the electrostatic latent image formed on the photosensitive medium 131. Here, the photosensitive medium 131, the light scanning unit 133 and the development unit 135 are provided by each color along a transporting path of the printable medium, and are configured as a tandem type.

The transferring unit 140 is disposed to face a plurality of photosensitive media 131 to interpose the printable medium M transported through the transporting path therebetween, and transfers the toner image formed on the photosensitive medium 131 to the supplied printable medium M. For this, the transferring unit 140 includes a transferring belt 141 disposed to face the plurality of photosensitive media 131.

The fusing unit 150 configures the fusing system according to an example embodiment of the present invention, forms a fusing nip by means of a pressing force, and heats and presses the printable medium passing through the fusing nip to fuse (fix) an image transferred to the printable medium.

Hereinafter, "printing operation" means a total process forming a visible image to a printable medium based on processed image data, that is, supplying of the printable medium, developing, transferring, fusing and discharging processes. Also, "starting of the printable medium operation" means a point of time in which the printable medium M loaded in a cassette 121 provided to the printable medium supplying unit 120 is picked up by a picking up roller 123.

Figure 5:
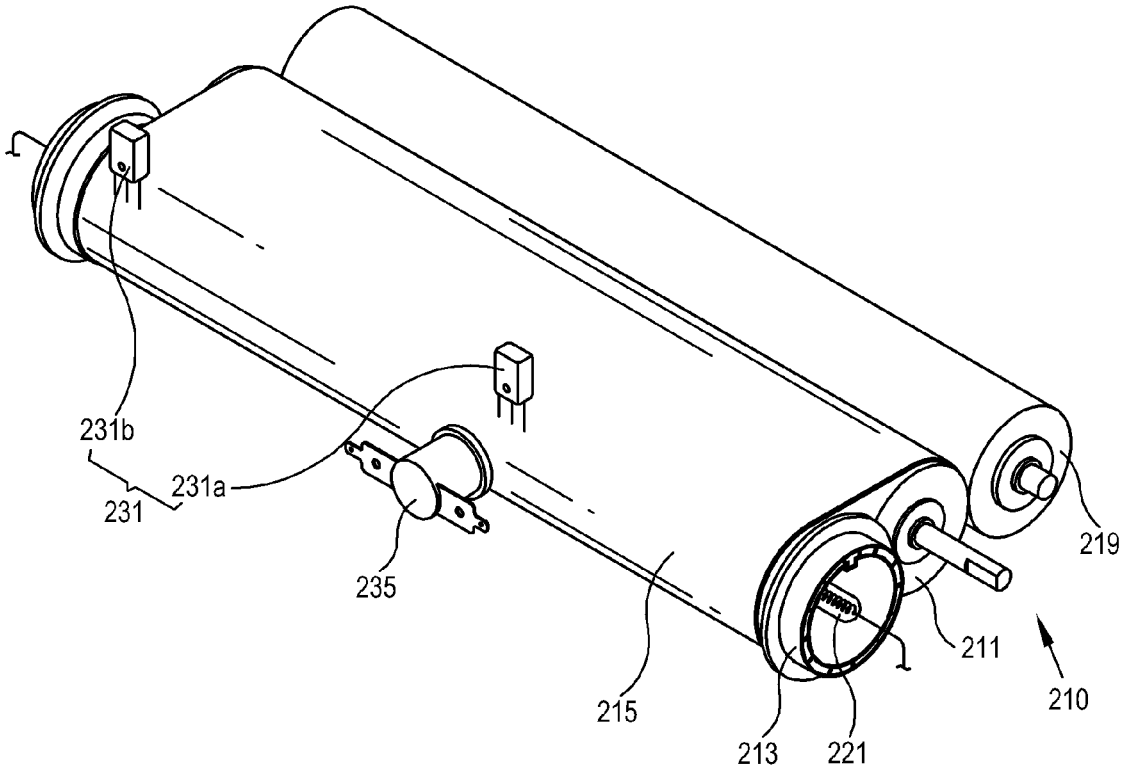
FIG. 5 is a perspective view illustrating a main portion of a fusing system according to a example embodiment of the present invention.
Figure 6:
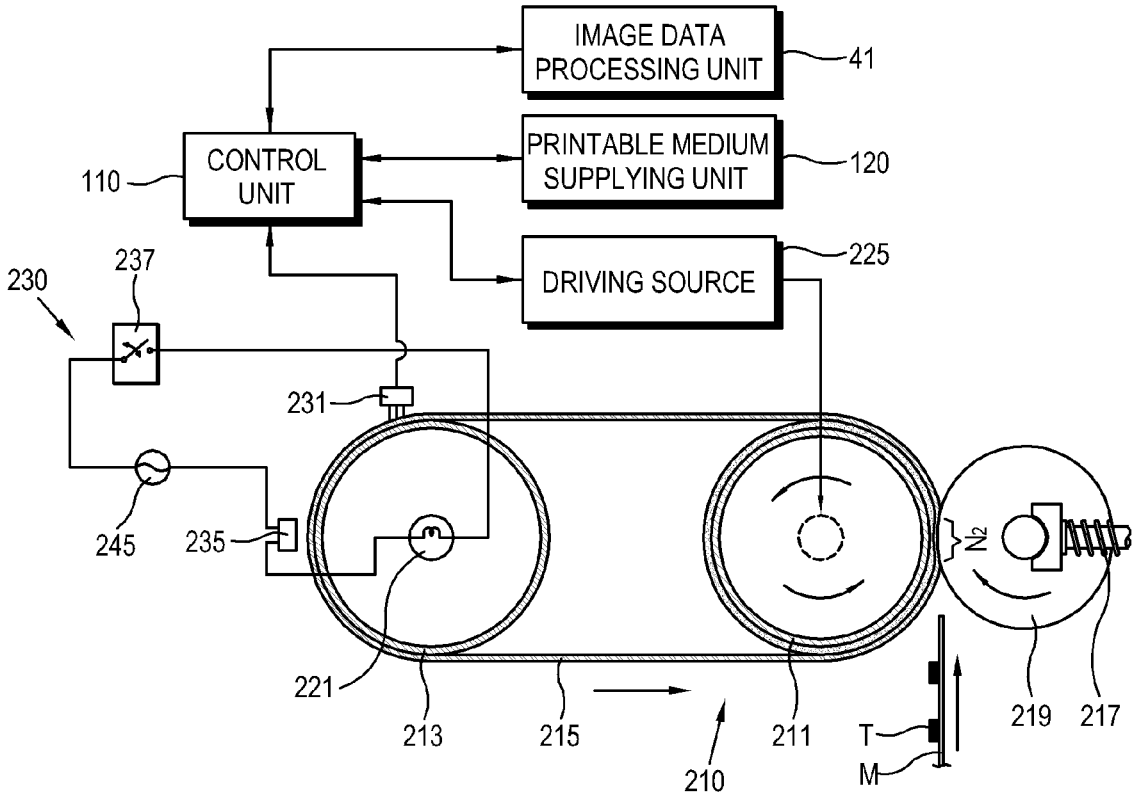
FIG. 6 is a schematic view illustrating the fusing system according to an example embodiment of the present invention.

FIG. 5 is a perspective view illustrating a main portion of a fusing system according to an example embodiment of the present invention, and FIG. 6 is a schematic view illustrating the fusing system according to the example embodiment of the present invention.

As shown in FIG. 5 and FIG. 6, the fusing system includes a fusing unit 210, a heat source 221 for supplying heat to the fusing unit 210, a driving source 225 for driving the fusing unit 210, a sensing unit 230, a control unit 110, and a power source 245. Here, the control unit 110, as shown in FIG. 6, controls all the components of the image forming apparatus, and is provided as one element of the fusing system according to the present exemplary embodiment of the present invention.

The fusing unit 210 includes at least one pair of rollers, a fusing belt 215 rotating against an outer surface of the rollers, and a pressing roller 219. In the example embodiment of the present invention, the pair of rollers includes a fusing roller 211, and a heating roller 213 distanced from the fusing roller 211 and containing the heat source 221 therein.

The fusing roller 211 is driven by the driving source 225 to rotate. Here, the fusing belt 215 is driven by means of tension and friction against the fusing roller 211. Also, the pressing roller 219 is elastically biased toward the fusing roller 211 by means of an elastic member 217 to press the printable medium M together with the fusing roller 211 and the fusing belt 215.

Accordingly, a fusing nip $N_2$ is formed between the fusing roller 211 and the pressing roller 219, and the fusing belt 215 is rotated within the fusing nip $N_2$ by means of a friction force and a pressing force. Here, as shown in FIG. 6, the pressing roller 219 is driven by means of the friction force against the fusing belt 215. In the example embodiment of the present invention, the fusing roller 211 is driven by means of the driving source 225. Alternatively, the heating roller 213 may be driven by means of the driving source 225.

The heat source 221 is provided as a halogen lamp, etc. and emits the heat by means of a voltage applied from the power source 245. A surface of the heating roller 213 is heated by radiation and convection of the heat emitted from the heat source 221.

In the example embodiment of the present invention, the heat source 221 is mounted inside the heating roller 213. Alternatively, the heat source 221 may be mounted inside the fusing roller 211.

Here, a portion of the fusing belt 215 contacting to the heating roller 213 is partially heated. Also, in fusing, the heated portion is expanded to the total surface of the fusing belt 215 by means of rotation of the fusing belt 215 so that a fusing temperature can be maintained at a fusing position.

The sensing unit 230 senses the temperature of the fusing unit 210, and includes a thermistor 231, a thermostat 235 and a power switching unit 237.

In the example embodiment shown in FIG. 5 and FIG. 6, the thermistor 231 senses a surface temperature of the fusing belt 215 at an area of the fusing belt 215, and transmits the sensed result to the control unit 110. The thermistor 231 may include a first thermistor 231*a* positioned to a central portion in a widthwise direction of the fusing belt 215, and a second thermistor 231*b* positioned to an edge portion thereof. Accordingly, a temperature variation of the central portion and edge portion of the fusing belt 215 can be sensed.

If the surface temperature of the fusing belt 215 exceeds a predetermined critical temperature, the thermostat 235 blocks the power source 245 applied to the heat source 221 to prevent a fire due to an abnormal control. Also, the power switching unit 237 turns ON/OFF for supplying of the power source 245 to the heat source 221 depending on a control signal from the control unit 110.

If the printing order is applied, the control unit 110 controls the heat source 221 and the driving source 225 so that the fusing belt 215 can be driven when the temperature of the fusing unit 210 increases. For this, the control unit 110 compares the temperature sensed by the thermistor 231 with a predetermined critical temperature to control a power supply to the heat source 221 through the power switching unit 237, and controls the driving source 225 based on a printing proceeding state. Accordingly, the surface temperature of the fusing belt 215 can maintain a printing standby temperature $T_1$, a preliminary fusing temperature $T_2$ or a fusing temperature $T_3$ depending on a predetermined condition.

More specifically, the control unit 110 controls the heat source 221 so that the temperature of the fusing unit 210 can maintain the preliminary fusing temperature $T_2$ which is higher than the printing standby temperature $T_1$, and lower than the fusing temperature $T_3$ during an image data processing time until the printing operation is started after the printing order is received from the host 40 shown in FIG. 3. Here, the printing standby temperature $T_1$ is the temperature of the fusing unit 210 by means of preheating in a printing standby state; and the fusing temperature $T_3$ is the temperature of the fusing unit 210 during the printing operation. For this, the control unit 110 controls the heat source 221 to drive during the image data processing time.

Figure 7:
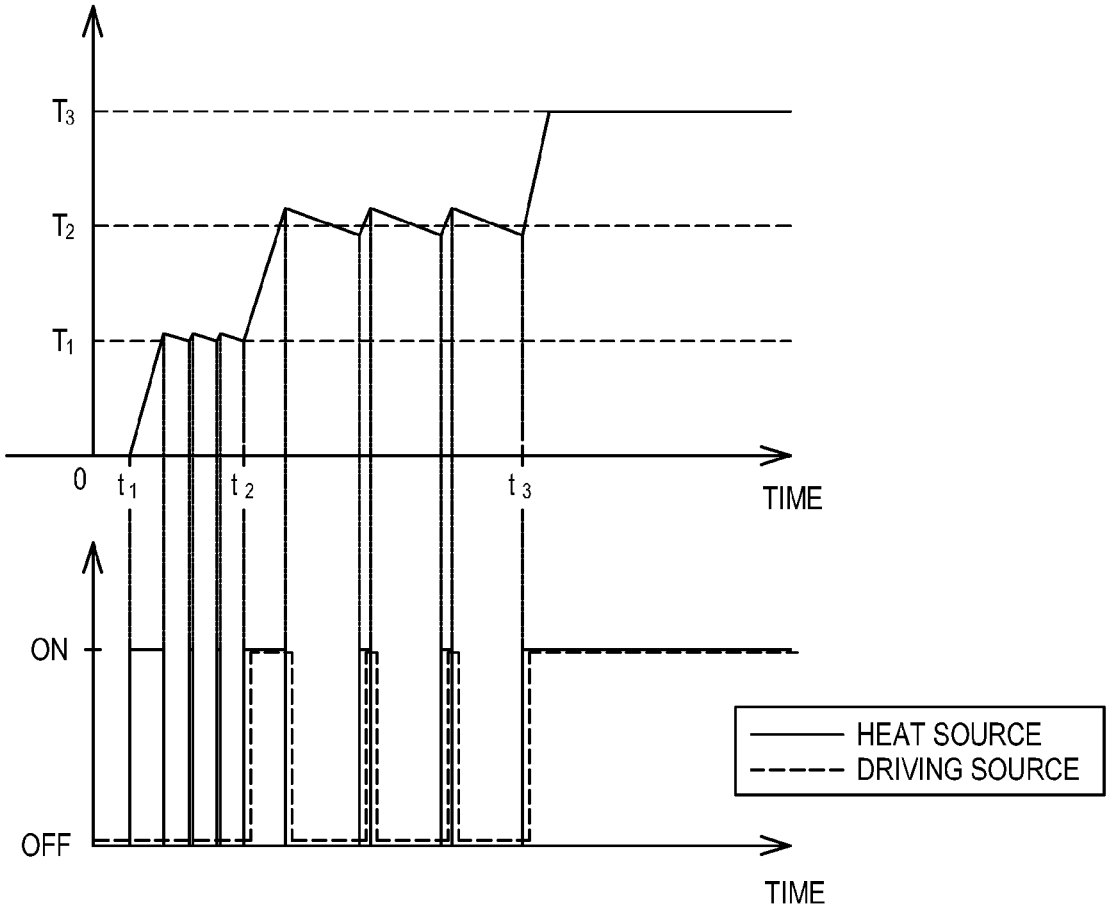
FIG. 7 is a graph illustrating an example of a turning on and off control for a heat source and a driving source depending on a printing process.

FIG. 7 is a graph illustrating an example of a turning ON/OFF control for the heat source and the driving source depending on a printing operation. As shown in FIG. 7, section 0~$t_1$ refers to a state in which the power is not applied to the image forming apparatus; section $t_1$~$t_2$ refers to a printing standby state; section $t_2$~$t_3$ refers to an image data processing state which is before performing the printing operation but after receiving the printing order; and section after $t_4$ refers to a fusing state.

At first, in the printing standby state which is before performing the printing order, the fusing unit 210 is not driven (the driving source 225 is turned OFF), and the heat source 221 is controlled to turn ON/OFF so that the fusing unit 210 can maintain the printing standby temperature $T_1$.

Then, in the section $t_2$~$t_3$, the control unit 110 turns ON/OFF the heat source 221 by a predetermined time unit so that the surface temperature of the fusing belt 215 heated by the heat source 221 can maintain the preliminary fusing temperature $T_1$. Here, the preliminary fusing temperature T2 means value having a predetermined range. The control unit 110 applies the power to the heat source 221 if the surface temperature of the fusing belt 215 sensed by the thermistor 231 deviates from a lower limit value of the preliminary fusing temperature $T_2$, and blocks the power applied to the heat source 221 if the surface temperature of the fusing belt 215 deviates from an upper limit value of the preliminary fusing temperature $T_2$. Accordingly, although the image data processing time varies due to difference of the type of the emulator and the amount of printing data, the preliminary fusing temperature $T_2$ having a predetermined range can be maintained.

Also, the control unit 110 turns ON/OFF the driving source 225 so that the driving source 225 can be driven during the image data processing time. Here, as shown in FIG. 7, the turning ON/OFF control of the driving source 225 may be delayed by a predetermined time with respect to a turning ON/OFF control period of the heat source 221. This is for considering time which is needed to heat the surface of the fusing belt 215 by means of the heat source 221, and to drive the fusing belt 215 after the surface of the fusing belt 215 is heated to a certain degree. Also, it is unnecessary to synchronize the turning ON/OFF control of the driving source 225 with the turning ON/OFF control of the heat source 221. The turning ON/OFF control of the driving source 225 may be independently controlled.

Accordingly, in maintaining the preliminary fusing temperature $T_2$, the fusing belt 215 can be prevented from being partially heated, and the total area of the fusing belt 215 can have uniform temperature distribution. Accordingly, if a first part of the fusing belt 215 is preheated to maintain the printing standby temperature $T_1$, a second part of the fusing belt 215 stopping for a long time without contacting with the heating roller 213, especially, a part thereof positioned to the fusing nip $N_2$ can be supplied with the heat so that the total area of the fusing belt 215 can maintain the preliminary fusing temperature $T_2$.

Finally, if the printing operation is started, the heat source 221 and the driving source 225 are controlled to turn ON/OFF so that the surface temperature of the fusing belt 215 can the fusing temperature $T_3$. As shown in FIG. 7, the heat source 221 and the driving source 225 continuously maintain the turned ON state in the fusing process. Alternatively, the heat source 221 and the driving source 225 may be turned ON/OFF by a predetermined time unit.

The fusing system as described above can reduce an temperature increasing time from the preliminary fusing temperature to the fusing temperature if the printing operation is started, and increase the fusing temperature in printing a first page for the printable medium, thereby avoiding an inferior fusing process.

Figure 8:
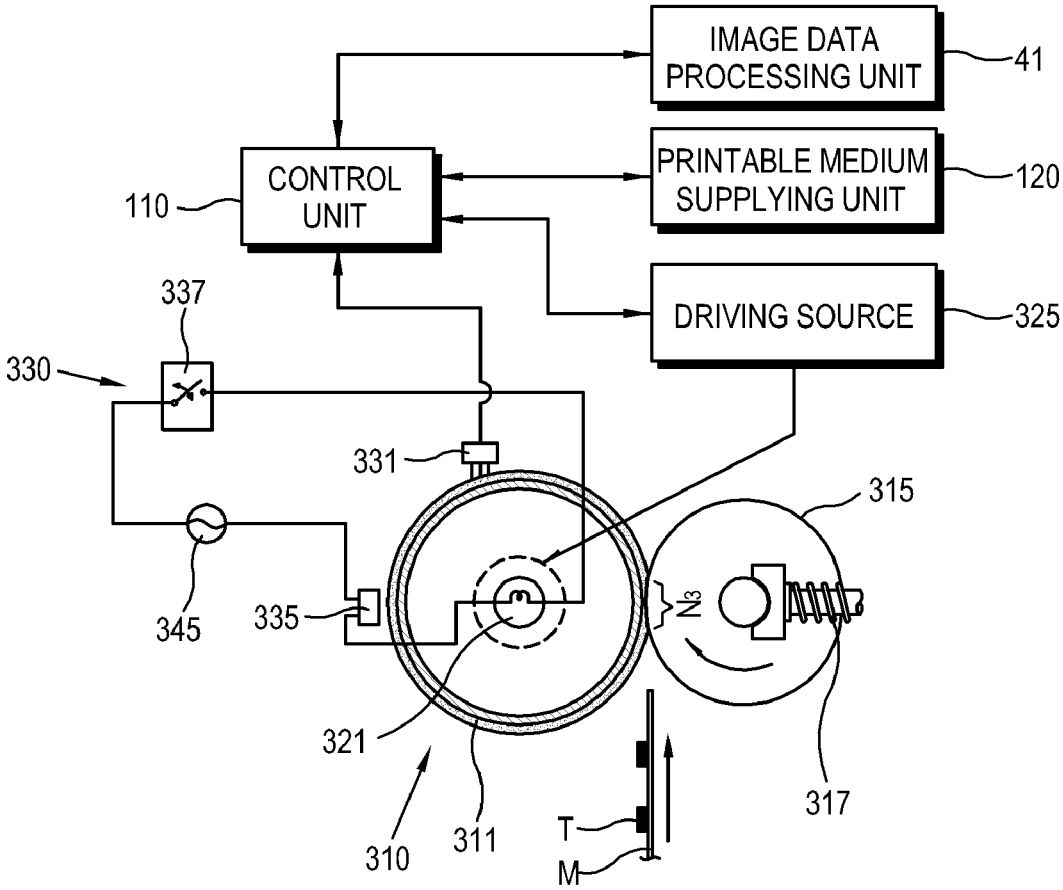
FIG. 8 is a schematic view illustrating a fusing system according to another example embodiment of the present invention.

FIG. 8 is a schematic view illustrating a fusing system according to another example embodiment of the present invention. As shown in FIG. 8, the fusing system includes a fusing unit 310, a heat source 321 for supplying heat to the fusing unit 310, a driving source 325 for driving the fusing unit 310, a sensing unit 330, a control unit 110, and a power source 345. Here, the control unit 110 controls all the components of the image forming apparatus, and is provided as one element of the fusing system according to the example embodiment of the present invention.

The fusing unit 310 includes a fusing roller 311 containing the heat source 221 therein, and a pressing roller 315 elastically biased toward the fusing roller 311.

The fusing roller 311 is driven by the driving source 325 to rotate. Also, the pressing roller 315 is elastically biased toward the fusing roller 311 by means of an elastic member 317 to press a printable medium M together with the fusing roller 311.

Accordingly, a fusing nip $N_3$ is formed between the fusing roller 311 and the pressing roller 315, and as shown in FIG. 8, the pressing roller 315 is driven by means of a friction force applied against the fusing roller 311.

The sensing unit 330 senses the temperature of the fusing unit 310, and includes a thermistor 331, a thermostat 335 and a power switching unit 337. Here, the sensing unit 330 may have the same configuration as the sensing unit 230 according to an example embodiment of the present invention, shown in FIG. 6.

The control unit 110 compares the temperature sensed by the thermistor 331 with a predetermined critical temperature to control a power supplying to the heat source 321 through the power switching unit 337, and controls the driving source 325 based on a printing proceeding state. Accordingly, a surface temperature of the fusing roller 311 can maintain a printing standby temperature $T_1$, a preliminary fusing temperature $T_2$ or a fusing temperature $T_3$ depending on a predetermined condition. Here, the configuration for controlling the surface temperature of the fusing roller 311 to be T1, T2 and T3, and driving the fusing unit 310 may be the same as the temperature control and driving control configurations of the fusing unit 210, shown in FIG. 6.

The fusing systems according to both example embodiments of the present invention as described in connection to FIG. 6 and FIG. 8, can heat the total fusing unit to have the preliminary fusing temperature which is higher than the printing standby temperature and lower than the fusing temperature before performing the printing operation to reduce the temperature increasing time from the preliminary fusing temperature to the fusing temperature if the printing operation is started. In addition, the fusing systems according to both example embodiments of the present invention can increase the fusing temperature in printing a first page for the printable medium, thereby avoiding an inferior fusing process.

Figure 9:
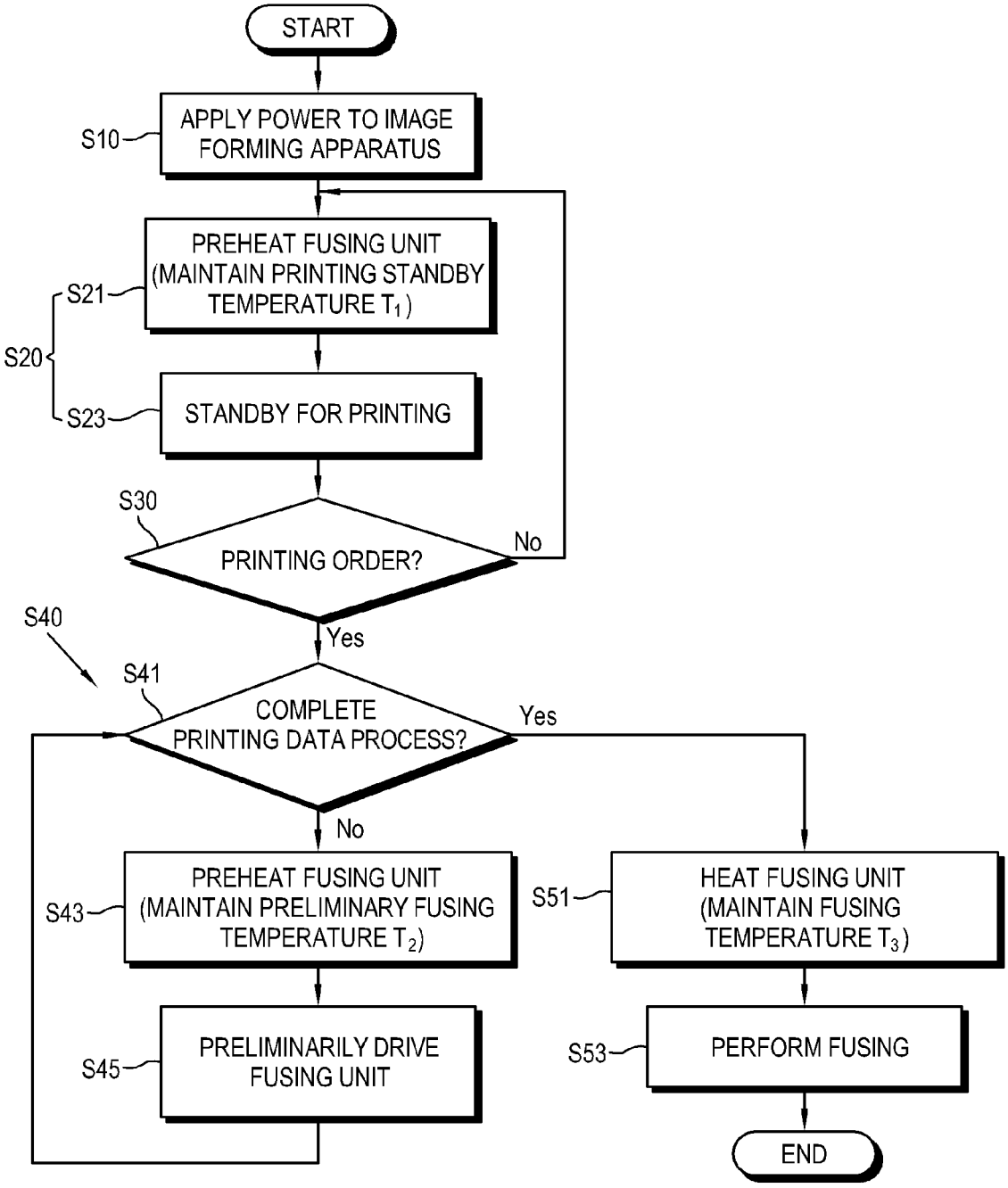
FIG. 9 is a flowchart illustrating a control method of a fusing system according to an example embodiment of the present invention.

FIG. 9 is a flowchart illustrating a control method of a fusing system according to an example embodiment of the present invention.

As shown in FIG. 6 and FIG. 9, the control method of the fusing system according to an example embodiment of the present invention includes applying power to an image forming apparatus at block S10, standing by for printing at operation S20, controlling a fusing unit 210 during an image data processing time before starting a printing operation after applying a printing order at operation S40, and controlling the fusing unit 210 to maintain a fusing temperature after starting the printing operation.

If a power is applied to an image forming apparatus 100 shown in FIG. 4 at block S10, the fusing unit 210 is preheated for reducing a temperature increasing time up to a fusing temperature for printing, and a printing standby state is maintained at operation S20. That is, in the present operation, a surface temperature of a fusing belt 215 is sensed by means of a thermistor 231, and a power is applied to a heat source 221 so that the fusing unit 210 can be preheated to maintain a printing standby temperature T1 at block S21. Then, the printing standby state is maintained until the printing order is received from a host 40 at block S23.

Then, whether the printing order is received from the host 40 or not is determined at block S30 before a preliminary fusing operation or a fusing operation is performed if the printing order is received at operation S40.

The preliminary fusing operation is performed during a time before starting the printing operation after receiving the printing order, that is, during processing the printing data, and the fusing operation is performed after starting the printing operation. For this, the preliminary fusing operation includes determining whether the printing data processing is completed or not after the printing order at block S41.

The preliminary fusing operation controls the heat source 221 and a driving source 225 so that the fusing belt 215 can be driven when the temperature of the fusing unit 210 increases if the printing order is applied. The preliminary fusing operation includes an operation of preheating the fusing unit 210 to maintain the preliminary fusing temperature $T_2$ at block S43, and an operation of preliminarily driving the fusing unit 210 at block S45.

At block S41, the fusing unit 210 is supplied with heat so that the fusing unit 210 can maintain the preliminary fusing temperature $T_2$ which is higher than the printing standby temperature $T_1$, and lower than the fusing temperature $T_3$. Here, in maintaining the preliminary fusing temperature $T_2$ at block S43, the heat source 221 may be controlled to turn ON/OFF to be driven by a predetermined time unit.

In the preliminary driving operation of the fusing unit 210 at block S45, the driving source 225 is controlled to drive the fusing unit 210 during the image data processing time. Accordingly, in maintaining the preliminary fusing temperature $T_2$, the fusing belt 215 can be prevented from being partially heated, and the total area of the fusing belt 215 can have uniform temperature distribution.

The preliminary driving operation of the fusing unit 210 at block S45 may be the essentially same as the above described by referring to FIG. 7.

The fusing operation includes an operation of controlling the heat source 221 so that temperature of the fusing unit 210 can maintain the fusing temperature $T_3$ at block S51. Accordingly, the fusing unit 210 is heated by means of the heat emitted from the heat source 221. Then, a printable medium M is supplied from a printable medium supplying unit 120, and a toner image transferred to the printable medium M through developing and transferring processes is pressed and heated to perform fusing at block S53.

Hereinafter, a temperature variation of fusing systems according to a comparative example and the example embodiment of the present invention depending on a printing page number variation will be described as follows.

Figure 10:
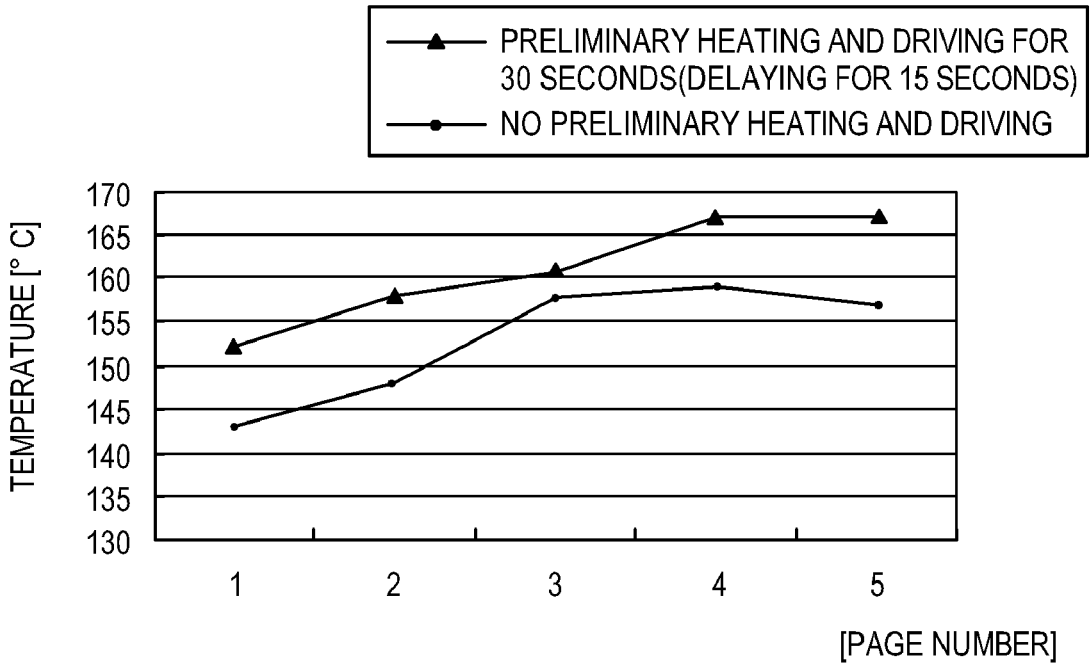
FIG. 10 is a graph illustrating temperature variations of fusing systems according to a comparative example and an example embodiment of the present invention depending on a printing page number variation of the fusing systems.

As shown in FIG. 10, the comparative example, which is represented as the solid circles, is a graph illustrating a temperature variation in case of a temperature increase from the printing standby temperature T1 to the fusing temperature T3 without preliminary heating and driving. The example embodiment of the present invention, which is represented as the solid triangles, includes the configuration of the fusing system, shown in FIG. 6, and is a graph illustrating a temperature variation in the case that the fusing unit 210 is preheated for 30 seconds in a preliminary fusing operation, and then, the temperature increases up to the fusing temperature T3 after delaying for 15 seconds. The preheating for 30 seconds applies heat of 175° C. to the fusing belt 215 while driving the fusing belt 215 through the driving source 225.

As shown in FIG. 10, related to the fusing temperature during printing a first page of the printable medium, the fusing temperature according to the example embodiment of the present invention is approximately 152° C., and is higher by approximately 9° C. than the fusing temperature according to the comparative example which is approximately 143° C. Also, the exemplary embodiment totally has a higher temperature distribution in a continuous printing. Accordingly, since the temperature can be maintained to be higher than the printing standby temperature, the temperature can stably vary when increasing up to the fusing temperature.

As described above, the present invention provides a fusing system and a control method thereof preliminarily driving a fusing unit during an image data processing time before a printing operation is started after a printing order so that the fusing unit can maintain a preliminary fusing temperature which is higher than a printing standby temperature. Accordingly, a temperature increasing time up to a fusing temperature can be reduced in performing the printing operation which has continuous processes of supplying a printable medium, developing, transferring and fusing, thereby reducing time for a first page printing. Also, the fusing temperature in starting printing can be increased, thereby avoiding an inferior fusing process when printing a first page of a printable medium.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. Accordingly, it is intended, therefore, that the present invention not be limited to the various example embodiments disclosed, but that the present invention includes all embodiments falling within the scope of the appended claims.

What is claimed is:

1. A fusing system, comprising:

a fusing unit which comprises a fusing belt to rotate around outer surfaces of at least two rollers which are distanced from each other, and a pressing roller to press a printable medium together with the fusing belt and fuse an image which is transferred to the printable medium;

a heat source which receives power to generate heat, and is mounted inside at least one of the two rollers;

a driving source which drives at least one of the two rollers;

a sensing unit which senses a temperature of the fusing unit; and a control unit which controls the heat source and the driving source so that the temperature of the fusing unit increases during a processing time of an image data before a printing operation is started after a printing order is applied.

2. The fusing system according to claim 1, wherein the control unit controls the heat source and the driving source based on the temperature of the fusing unit which is sensed by the sensing unit, and a printing proceeding state.

3. The fusing system according to claim 1, wherein the controlling the heat source and the driving source comprises controlling the heat source so that the temperature of the fusing unit can maintain a preliminary fusing temperature $T_2$ which is higher than a printing standby temperature $T_1$, and lower than a fusing temperature $T_3$.

4. The fusing system according to claim 3, wherein the printing standby temperature $T_1$ is the temperature of the fusing unit by means of preheating in a printing standby state, and the fusing temperature $T_3$ is the temperature of the fusing unit during the printing operation.

5. The fusing system according to claim 4, wherein the control unit respectively turns ON/OFF the heat source and the driving source so that the heat source and the driving source can be respectively driven by a predetermined time unit during the image data processing time.

6. A fusing system, comprising:

a fusing unit which forms a fusing nip by means of a pressing force, and heats and presses a printable medium which passes through the fusing nip to fuse an image which is transferred to the printable medium;

a heat source which receives power to generate heat, and supplies the heat to the fusing unit;

a driving source which drives the fusing unit;

a sensing unit which senses a temperature of the fusing unit; and a control unit which controls the heat source and the driving source based on the temperature of the fusing unit, and a printing proceeding state, wherein the control unit controls the heat source so as to maintain the temperature of the fusing unit at a preliminary fusing temperature $T_2$ which is higher than a printing standby temperature $T_1$, and lower than a fusing temperature $T_3$ during an image data processing time before a printing operation is started after a printing order is applied.

7. The fusing system according to claim 6, wherein the printing standby temperature $T_1$ is the temperature of the fusing unit by means of preheating in a printing standby state, and the fusing temperature $T_3$ is the temperature of the fusing unit during the printing operation.

8. The fusing system according to claim 7, wherein the control unit turns ON/OFF the heat source so that the heat source can be driven by a predetermined time unit during the image data processing time.

9. The fusing system according to claim 8, wherein the control unit turns ON/OFF the driving source so that the driving source can be driven by a predetermined time unit during the image data processing time.

10. The fusing system according to claim 6, wherein the fusing unit comprises:

a fusing roller which is driven by means of the driving source, a heating roller which is distanced from the fusing roller, and contains the heat source therein, a fusing belt which rotates around outer surfaces of the fusing roller and the heating roller, and a pressing roller which is elastically biased toward the fusing roller to press the printable medium together with the fusing roller and the fusing belt.

11. The fusing system according to claim 6, wherein the fusing unit comprises:

a fusing roller which is driven by means of the driving source, and contains the heat source therein, and a pressing roller which is elastically biased toward the fusing roller to press the printable medium together with the fusing roller.

12. A control method of a fusing system which comprises a fusing unit which comprises a fusing belt which rotates around outer surfaces of at least two rollers which are distanced from each other, and a pressing roller which presses a printable medium together with the fusing belts and fuses an image which is transferred to the printable medium, the control method of the fusing system comprising:

preheating the fusing unit so that a temperature of the fusing unit can maintain a printing standby temperature, and standing by for printing until a printing order is applied;

controlling a heat source according to a state of processing image data and a driving source so that the fusing belt can be driven when the temperature of the fusing unit increases if the printing order is applied; and controlling the heat source so that the temperature of the fusing unit can maintain a fusing temperature after a printing operation is started.

13. The control method of the fusing system according to claim 12, wherein the controlling the heat source and the driving source comprises controlling the heat source so that the temperature of the fusing unit can maintain a preliminary fusing temperature $T_2$ which is higher than a printing standby temperature $T_1$, and lower than a fusing temperature $T_3$ during a processing time of the image data before the printing operation is started after the printing order is applied.

14. The control method of the fusing system according to claim 13, wherein the controlling the heat source and the driving source comprises respectively turning ON/OFF the heat source and the driving source so that the heat source and the driving source can be driven by a predetermined time unit during the image data processing time.

15. A control method of a fusing system, comprising:

preheating a fusing unit which fuses an image which is transferred to a printing medium so that the temperature of the fusing unit can maintain a printing standby temperature $T_1$, and standing by for printing until a printing order is applied;

controlling a heat source which supplies heat to the fusing unit so that the temperature of the fusing unit can maintain a preliminary fusing temperature $T_2$ which is higher than the printing standby temperature $T_1$, and lower than a fusing temperature $T_3$ during an image data processing time before a printing operation is started after the printing order is applied; and controlling the heat source so that the temperature of the fusing unit can maintain a fusing temperature $T_3$ after the printing operation is started.

16. The control method of the fusing system according to claim 15, wherein the controlling the heat source during the image data processing time comprises turning ON/OFF the heat source so that the heat source can be driven by a predetermined time unit.

17. The control method of the fusing system according to claim 16, further comprising controlling a driving source which drives the fusing unit so that the fusing unit can be driven during the image data processing time.

18. An image forming apparatus comprising:

a fusing unit arranged to fuse a toner image onto a printable medium;

a sensing unit arranged to sense a temperature of the fusing unit; and a control unit responsive to the sensing unit to control the fusing unit so as to maintain the temperature of the fusing unit at a preliminary fusing temperature $T_2$ that is higher than a printing standby temperature $T_1$ during an image data processing time after receipt of a printing order, and at a fusing temperature $T_3$ that is higher than the preliminary fusing temperature $T_2$ upon completion of the image data processing time for fusing the toner image onto the printable medium.

19. The image forming apparatus according to claim 18, wherein the printing standby temperature $T_1$ is the temperature of the fusing unit by means of preheating in a printing standby state, and the fusing temperature $T_3$ is the temperature of the fusing unit during a printing operation.

20. The image forming apparatus according to claim 18, wherein the fusing unit comprises:

a fusing roller driven by a driving source;

a heating roller arranged adjacent to the fusing roller, and includes a heat source therein;

a fusing belt arranged to cover the fusing roller and the heating roller to rotate around outer surfaces of the fusing roller and the heating roller; and a pressing roller elastically biased toward the fusing roller, to press the printable medium together with the fusing roller and the fusing belt.

21. The image forming apparatus according to claim 20, wherein the control unit controls the heat source and the driving source based on the temperature of the fusing unit so that the heat source and the driving source can be driven by a predetermined time unit during the image data processing time.

22. The image forming apparatus according to claim 18, wherein the fusing unit comprises:

a fusing roller driven by a driving source, and contains a heat source therein; and a pressing roller elastically biased toward the fusing roller to press the printable medium together with the fusing roller.

23. The image forming apparatus according to claim 22, wherein the control unit controls the heat source and the driving source based on the temperature of the fusing unit so that the heat source and the driving source can be driven by a predetermined time unit during the image data processing time.

* * * * *